US006170757B1

(12) United States Patent
Herrmann et al.

(10) Patent No.: US 6,170,757 B1
(45) Date of Patent: Jan. 9, 2001

(54) FUEL INJECTION VALVE

(75) Inventors: Dieter Herrmann, Lauffen A.N.; Stephan Haas, Mammendorf; Thomas Kuegler, Korntal-Muenchingen, all of (DE)

(73) Assignee: Robert Bosch GmbH, Stuttgart (DE)

( * ) Notice: Under 35 U.S.C. 154(b), the term of this patent shall be extended for 0 days.

(21) Appl. No.: 09/465,841

(22) Filed: Dec. 17, 1999

(30) Foreign Application Priority Data

Jan. 2, 1999 (DE) ..... 199 00 037

(51) Int. Cl.[7] ..... F02M 47/02

(52) U.S. Cl. ..... 239/88; 239/90; 239/93; 239/96; 239/124; 239/533.7; 239/533.12

(58) Field of Search ..... 239/88, 90, 91, 239/92, 93, 94, 95, 96, 124, 533.2, 533.3, 533.4, 533.5, 533.7, 533.9, 533.12

(56) References Cited

U.S. PATENT DOCUMENTS 2,077,938 * 4/1937 Kuttner ..... 239/92 X
6,105,879 * 8/2000 Potz et al. ..... 239/96 X

* cited by examiner

*Primary Examiner*—Andres Kashnikow
*Assistant Examiner*—Robin O. Evans
(74) *Attorney, Agent, or Firm*—Ronald E. Greigg; Edwin E. Greigg

(57) ABSTRACT

A fuel injection valve for internal combustion engines, having a valve member that is displaceable axially outward counter to a restoring force in a bore of a valve body. On an end toward the combustion chamber, the valve member has a closing head. The closing head protrudes from the bore and forms a valve closing member and on a side toward the valve body has a valve sealing face. The valve closing member cooperates with a valve seat face, disposed on a face end toward the combustion chamber of the valve body. The valve closing member at least one injection opening on the closing head. The injection opening originating at a pressure chamber and outlet opening being covered, in the closing position of the valve member, by the valve body and being uncovered upon an outward-oriented opening stroke. A two-stage hydraulic stroke stop, which limits the opening stroke of the valve member and is embodied as a hydraulic damping chamber with a relief line that can be opened. The relief line can be made to communicate with the damping chamber via at least two recesses on the valve member, the two recesses can be opened in succession during the opening stroke motion of the valve member, and at least one of the recesses can be made to communicate with a low-pressure chamber via a relief conduit that contains a valve.

25 Claims, 5 Drawing Sheets

FUEL INJECTION VALVE

BACKGROUND OF THE INVENTION

The invention relates to a fuel injection valve for internal combustion engines.

One such valve member is disclosed by German Patent Application DE 197 33 905, which was not published by the filing date of the present application. Such a fuel injection valve for internal combustion engines has a valve member which emerges on the outside from the valve body and on which at least two rows of injection ports, located axially one above the other, are provided. The injection parts can be opened in succession in the outward-oriented opening stroke of the valve member. The injection parts have a two-stage hydraulic stroke stop that limits the opening stroke angle of the valve member and is embodied as a hydraulic damping chamber with a relief line that can be opened. The relief line is effected via at least two ground faces on the valve member which can be opened one after the other during the opening stroke motion of the valve member. One of the ground faces can be made to communicate with a low-pressure chamber via a relief conduit that contains a valve. The damping chamber is provided in a shim fastened between the valve body and a valve retaining body and is defined on an axial end opposite the end face of the valve body by a piston, secured to the valve member. The piston is guided by its outer circumference sealingly and slidingly displaceably along the wall of the damping chamber.

The piston is embodied as a plastic, U-shaped sealing ring open toward the damping chamber and pressed onto the shaft of the valve member. A spring is placed in the U-shaped sealing ring. A problem here is that the sealing ring suffers very great wear. Embodying the sealing ring as a metal is problematic because of its vulnerability in terms of tolerances.

OBJECT AND SUMMARY OF THE INVENTION

An object of the invention is to further develop a fuel injection valve of this type such that under the existing load conditions in an internal combustion engine, the fuel injection valve largely assures a constant function over its entire life. In particular, the risk of high abrasion at very short strokes at a high relative speed, the influence of production variations that occur in guides disposed close to one another in line, and pulsating impact stress on the fastening of the piston and on the valve member that result from the load pressure should be eliminated.

In a fuel injection valve of the type described at the outset, this object is attained by the characteristics set forth hereinafter.

The piston is embodied as a multi-part structure, including the piston element with a bearing face that rests on a curved contact face embodied on the valve member, and includes the retaining element for fixing the piston element to the valve member. In one version of the invention, the retaining element is connected via an elastic element disposed between the piston element and the retaining element. In another version of the invention, the retaining element rests on a face of the piston element, which face is toward the retaining element. With a bearing face adapted to this face of the piston element, an axial offset of the guides of the valve member, in the shim and of the valve retaining body, is advantageously realized by means of a sufficient relative displaceability of these parts to one another. In particular, incorrect orientations and errors of parallelism of the guides relative to one another can be compensated for in a technically easily achieved way by means of this kind of multi-part piston, with its faces adapted to one another.

In the second version, the two contact faces are advantageously embodied spherically or toroidally with concentric points of symmetry, and the bearing faces are embodied complimentary to the spherical or toroidal faces or are embodied conically. In this way, an axial offset of the guide of the valve member in the shim and of the nozzle body can be compensated for especially effectively by means of very good relative displaceability.

The retaining element is advantageously pressed onto the valve member and secured by a securing ring.

Alternatively, the retaining element can also be welded on and/or secured by positive engagement, preferably by a screw fastening.

In another embodiment, the retaining element is pressed by cold or hot deformation into grooves formed in the valve member.

Furthermore, the retaining element can also be welded to the valve member, preferably by laser welding.

It can also be provided that the retaining element is inserted into a groove, disposed in the valve member, and secured by an annular element surrounding the retaining element.

The elastic element is preferably embodied as an elastomer element, which fills a void formed between the valve member, the piston element and the retaining element.

The invention will be better understood and further objects and advantages thereof will become more apparent from the ensuing detailed description of the preferred embodiments taken in conjunction with the drawings.

DESCRIPTION OF THE PREFERRED EMBODIMENTS

Figure 1:
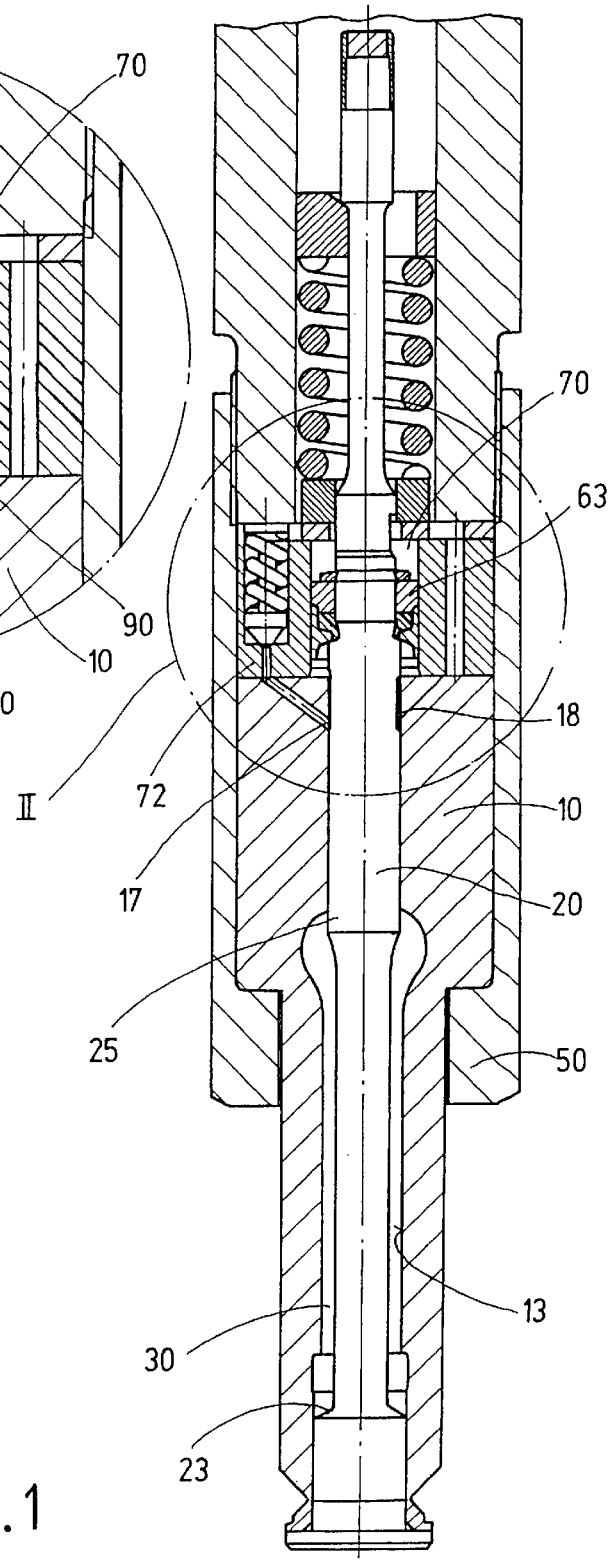
FIG. 1 shows a first exemplary embodiment of a fuel injection valve according to the invention.

A fuel injection valve shown in FIG. 1, of the type that opens outward and has two rows of injection nozzles that can be opened in succession (varioregister nozzle) has a valve body 10, which protrudes by a lower free end into the combustion chamber of the internal combustion engine to be supplied with fuel. The valve body 10 has an axial through bore 13, in which a piston-like valve member 20 is guided axially displaceably. The valve member 20, on a lower end toward the combustion chamber, has a closing head 23 of enlarged cross section that protrudes out of the bore 13 and forms a valve closing member. This closing head 23, with an annular end face toward the valve body 10, forms a valve sealing face. The valve sealing face cooperates with a stationary valve seat face that is formed on the end face, toward the combustion chamber and surrounding the bore 13, of the valve body 10. The valve sealing face and valve seat face, which result in a sealing cross section, are embodied conically, with the cone angles of the two contact faces deviating slightly from one another so that a defined sealing edge is formed.

Between the wall of the bore 13 and the shaft of the valve member 20, an annular pressure chamber 30 is formed. The annular pressure chamber is bounded toward the combustion chamber by a widening of a diameter of the valve member 20, forming an annular shoulder on the closing head 23 at the transition of the valve member to the closing head, and on the other side, by widening the cross section of the valve member 20 at 25 to the size of the bore 13. In a manner not shown in detail, the pressure chamber 30 is connected to an injection line of an injection pump via a pressure conduit, which cannot be seen in FIG. 3.

Figure 3:
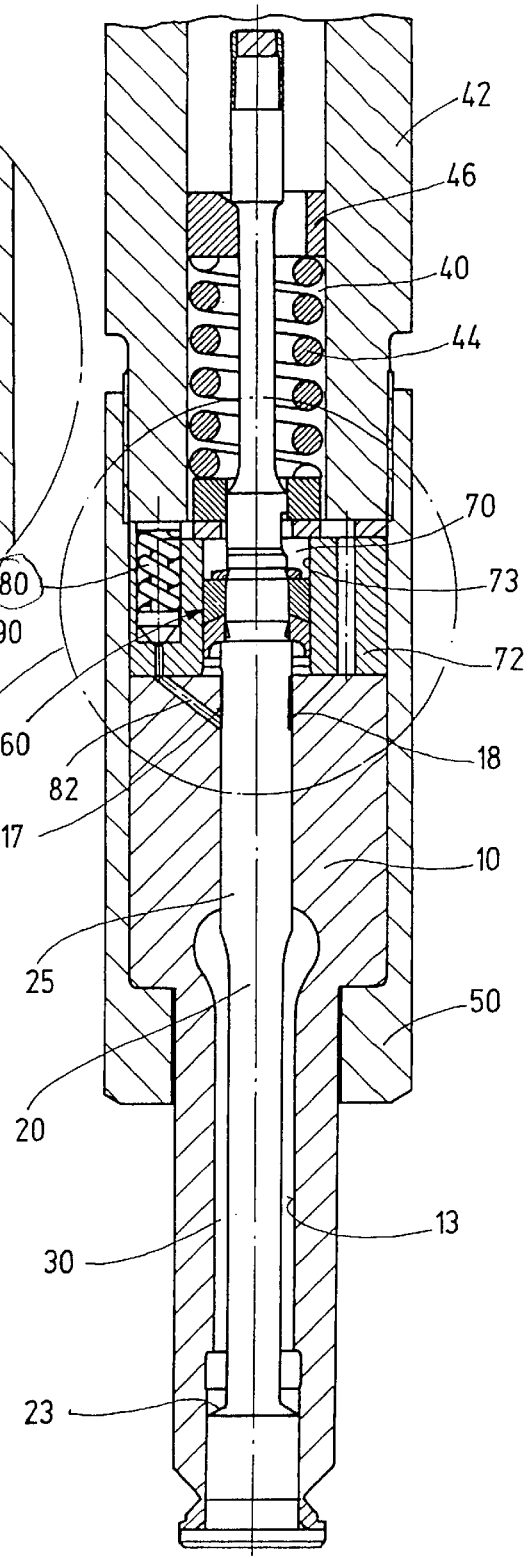
FIG. 3 shows a second exemplary embodiment of a fuel injection valve according to the invention.

Leading away from the annular shoulder that defines the pressure chamber 30 are injection conduits, which cannot be seen in FIGS. 1 and 3 and which are embodied for instance as longitudinal bores in the closing head of the valve member 20; from the longitudinal bores, control bores lead away at the level of the sealing edge. The outlet openings of the injection conduits are disposed above the valve sealing face on the jacket face of the closing head in such a way that the outlet openings are covered by the bore in the closing direction of the injection valve. In other words when the valve member 20 is seated on the valve seat the outlet openings are not opened until the outward-oriented opening stroke of the valve member 20, by emerging from the bore of the valve body. In addition, advantageously two rows of outlet openings (injection ports) disposed one above the other in the axial direction of the valve member 5 are provided. The two rows of outlet openings are opened in succession during the opening stroke motion of the valve member. As injection openings, longitudinal sections can also be provided, whose cross section in that case is then opened in at least two stages.

The piston-like valve member 20 protrudes with a shaft portion, remote from the combustion chamber, from the valve body 10 into a bore of widened cross section into a valve retaining body 42, that forms a spring chamber 40. The valve retaining body is braced axially towards the valve body 10 by means of a tightening nut 50. A valve closing spring 44 is fastened in the spring chamber 40 in such a way that with an end of the spring toward the combustion chamber, the spring is braced against the valve body, while with an end remote from the combustion chamber the spring acts on a valve plate 46 of the valve member and thus keeps the valve member 20 pressed against the valve seat.

For limiting an outward-oriented opening stroke motion of the valve member 20, the valve member 20, on an end remote from the combustion chamber and protruding into the valve retaining body 42 from the valve body 10, has a piston 60 (FIG. 2) that protrudes radially from the valve member shaft and defines a hydraulic damping chamber 70.

The damping chamber 70 is provided in an intermediate disk 72, which is fastened axially between an end face of the valve body 10 and the end face, of the valve retaining body 42. The intermediate disk 72 has a portion of the (not visible) pressure conduit, in the form of an axial through bore. The intermediate disk 72 also has a central through opening 73, through which the shaft of the valve member 10 protrudes and which defines the damping chamber 70 radially outward of the valve member.

The valve member 10 has two ground faces 17, 18, which can be opened in succession during the opening stroke motion of the valve member. One of the ground faces 17 can be made to communicate with a low-pressure chamber via a relief conduit 82 that contains a valve including a valve spring.

The function of both the ground faces and the valve disposed in the relief conduit 82 is disclosed in DE 197 39 905, which is hereby fully incorporated by reference and which was not published by the priority date of the present application.

Figure 2:
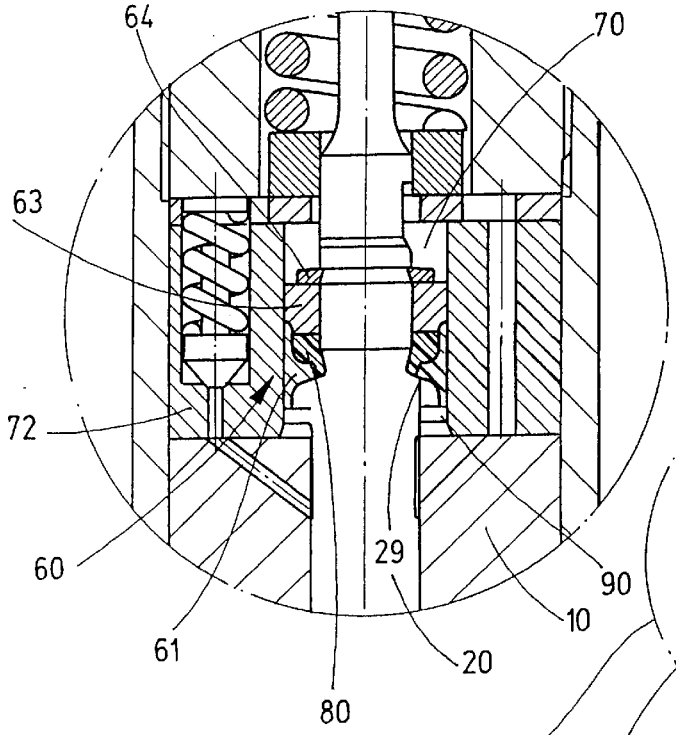
FIG. 2 shows a detail marked II in FIG. 1 on a larger scale.

As shown particularly in FIG. 2, the piston 60 has a piston element 61, which is fixed on the valve member 10 by a retaining ring that is press-fitted on the valve member with an oversize and that absorbs the static compressive force on the underside of the piston element 61 by frictional engagement. For absorbing the dynamic load, an unsplit securing ring 64 is provided, which is press-fitted with great oversize and axial prestressing onto the valve member 20.

Between the retaining ring 63 and the piston element 61, there is an elastomer element 80, which fills a void formed between the piston element 61, valve member 20 and retaining element 63.

The piston element 61 rests on a contact face 29 that is embodied spherically or toroidally. The bearing face of the piston element 61 toward the contact face 29 is embodied in dome-like or conical fashion, in complimentary fashion to the contact face. As a result of this disposition of the piston 60 in the pressure chamber 70, production variations in the guides of the valve member 20 and the valve body 10 and valve retaining body 42 and in the intermediate disk 72 can be eliminated effectively, as can a pulsating impact stress, resulting from the lug pressure, on the fastening of the piston 16 on the valve member 20. At the same time, very high resistance to abrasion is obtained by embodying the piston element 61 and the retaining element 63 as metal parts. Precisely because of the circular toroidal embodiment of the contact face 29 embodied on the valve member and of the bearing face, pressed onto the piston element 61, an adequate relative displaceability is achieved, which can compensate for an axial offset of the guidance and of the valve member 20 and intermediate disk 72 and valve body 10. An error in alignment of the guides, and especially tipping and non parallelism of the guides relative to one another is compensated for because the piston element 61 can move along a circular orbit about the center of the spherical or toroidal face, and the elastomer element 80 provides compensation relative to the valve member 20.

As an alternative to the embodiment shown, instead of being secured by the securing ring 64, which is elastically deformed by being pressed onto the valve member 20 and snaps into a slash that is provided on the valve member 20, the retaining ring 63 can also be embodied by a welded-on or positively engaged retaining ring 63, secured for instance by means of a locknut. The sealing off of a control chamber 90 acted upon by pressure is effected via the very close guidance of the piston element 61 and contact points between the valve member 20 and the piston element 61 and also by the elastomer element 80.

Figure 4:
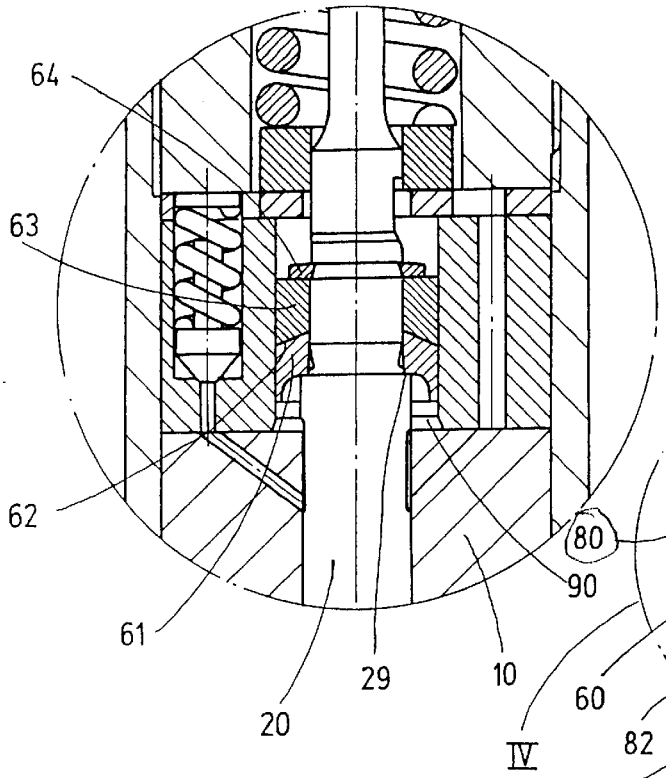
FIG. 4 shows a detail marked IV in FIG. 3 on a larger scale.

In another embodiment, shown in FIGS. 3 and 4, those elements that correspond to the exemplary embodiments of FIGS. 1 and 2 are identified by the same reference numerals, so that with respect to their description, the full content of the above remarks can be referred to.

In contrast to the exemplary embodiment shown in FIGS. 1 and 2, here the piston element 61 is not joined to the retaining ring 63 via an elastomer element. Instead, the piston element 61, on its side toward the retaining element 63, also has a contact face 62, which once again is embodied preferably spherically or toroidally. The retaining element 63, on its side toward the contact face 62, has a dome like bearing face complimentary thereto, or a conical bearing face. The contact face 29 embodied on the valve member 20, like the contact face 62 embodied on the piston element 61, both of them preferably being spherical contact faces, have an identical point of symmetry, or in other words an identical radial center point. By this embodiment again, the above-described axial and angular offsets that can occur as a result of tolerances are compensated for.

Figure 5:
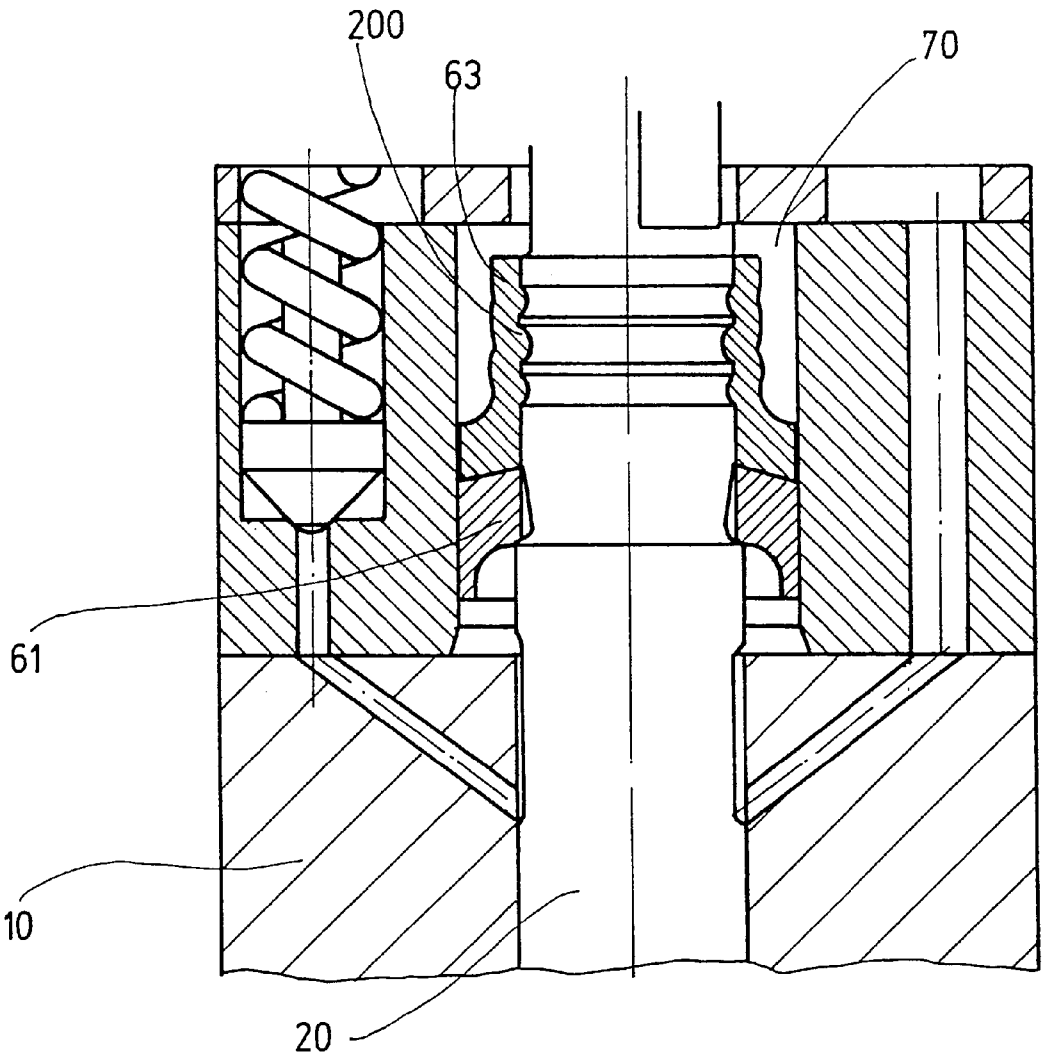
FIG. 5, illustrates a detail of a third exemplary embodiment of a fuel injection valve according to the invention.
Figure 6:
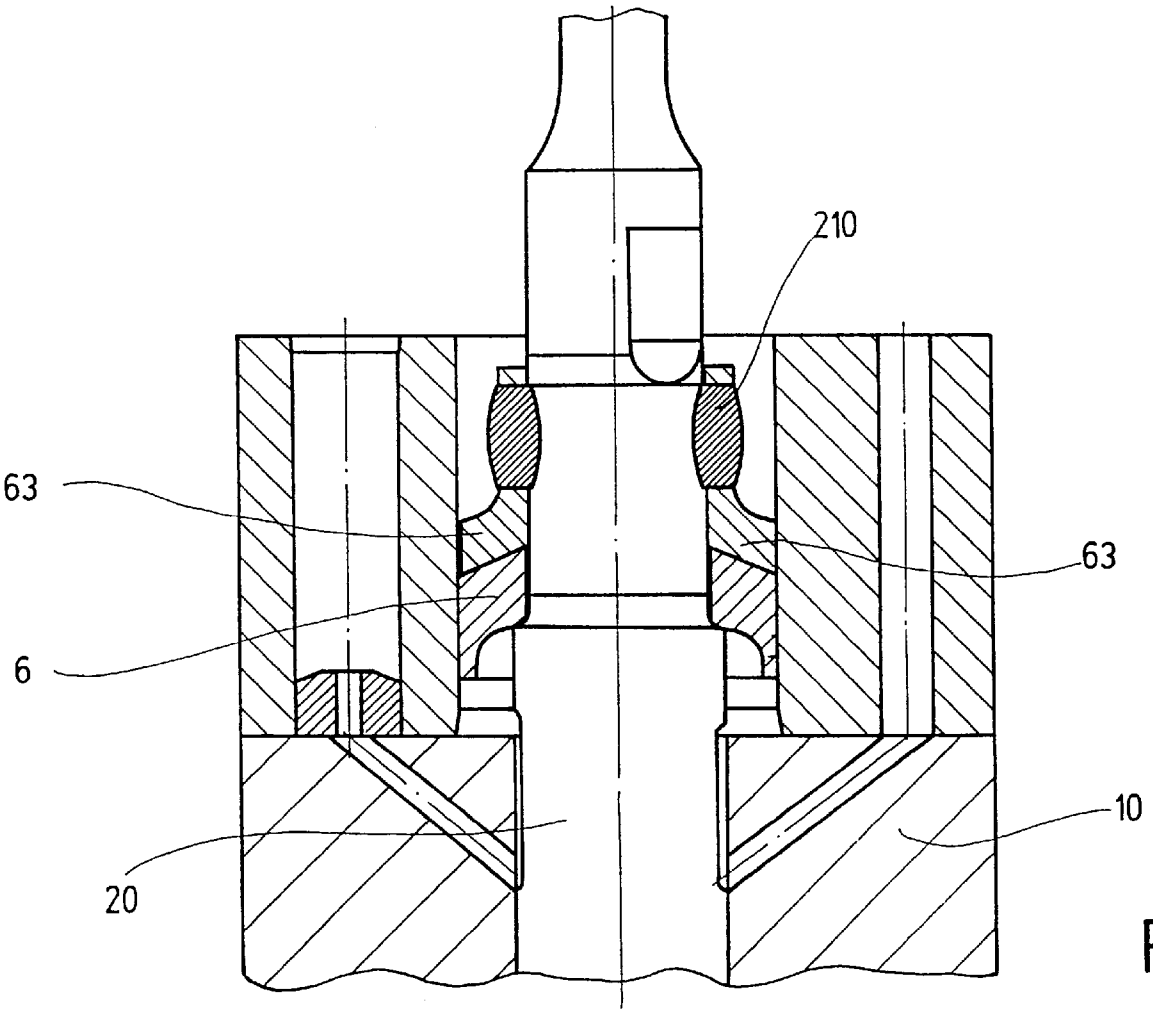
FIG. 6, illustrates a detail of a fourth exemplary embodiment of a fuel injection valve according to the invention.
Figure 7:
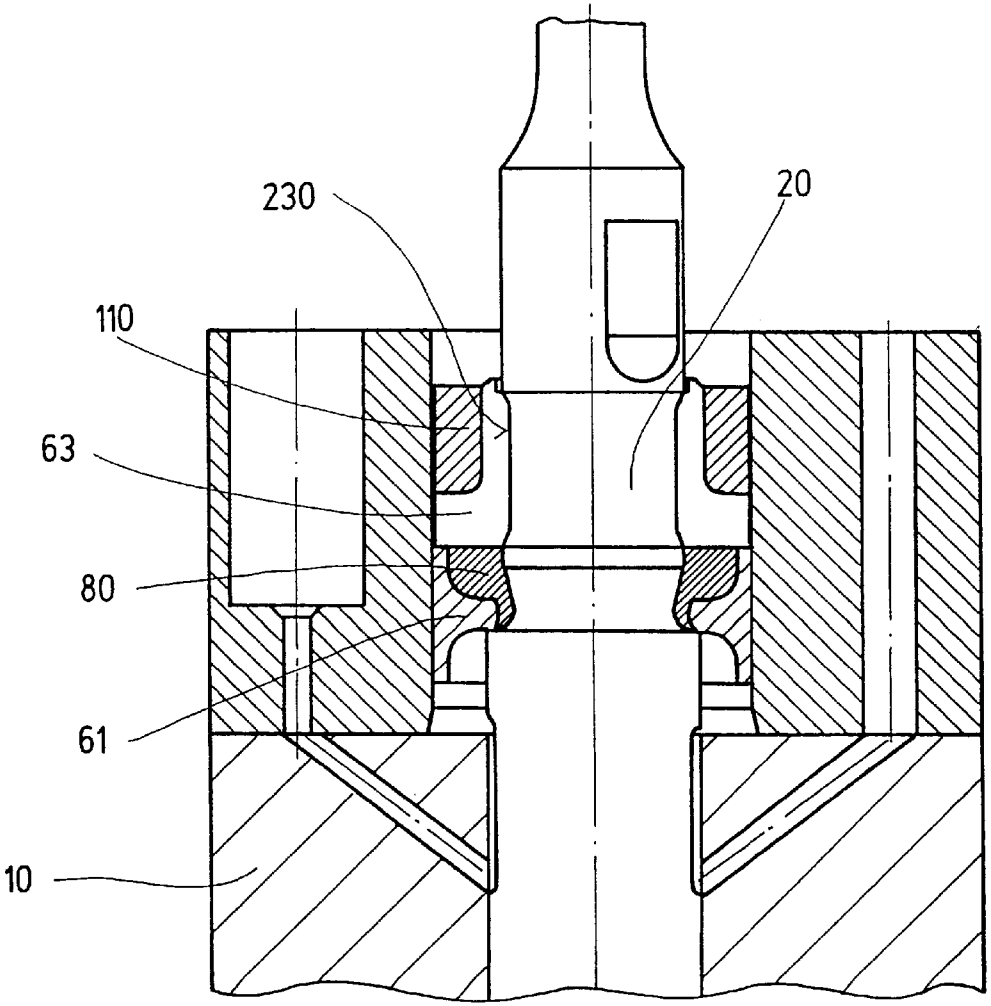
FIG. 7, illustrates a detail of a fifth exemplary embodiment of a fuel injection valve according to the invention.

In the embodiments shown in FIGS. 5, 6 and 7, those elements that correspond to the exemplary embodiments shown in FIGS. 1 and 2 are again identified by the same reference numerals, so that again the above remarks can be referred to in full for their description.

In the exemplary embodiment shown in FIG. 5, the retaining element 63 is pressed by cold or hot pressing into grooves 200 which are embodied in the valve member 20.

In the exemplary embodiment shown in FIG. 6, the retaining element is secured to the valve member 20 by laser welding. In FIG. 6, the laser welding grooves 210 are shown schematically.

In the exemplary embodiment shown in FIG. 7, the retaining element is inserted into a groove 230 formed in the valve member 20 and is secured with an annular element 110 extending annularly all the way around.

In this embodiment, an elastomer element 80 is disposed in a void intended for it between the piston element 61, retaining element 63 and valve member 20. This elastomer element is equivalent to the elastomer element shown in FIGS. 1 and 2 and described in conjunction with the embodiment of FIGS. 1 and 2.

The foregoing relates to a preferred exemplary embodiment of the invention, it being understood that other variants and embodiments thereof are possible within the spirit and scope of the invention, the latter being defined by the appended claims.

We claim:

1. A fuel injection valve for internal combustion engines, comprising a valve member (20) that is displaceable axially outward counter to a restoring force in a bore (13) of a valve body and that on an end toward the combustion chamber has a closing head (23), said closing head (23) protrudes from the bore (13) and forms a valve closing member and on a side of the valve closing head toward the valve body (10) has a valve sealing face, with which the valve closing head cooperates with a valve seat face, said valve seat face is disposed on a face end toward the combustion chamber of the valve body, at least one injection opening on the closing head, said at least one injection opening originating at a pressure chamber with an outlet opening being covered, in the closing position of the valve member, by the valve body and being uncovered upon an outward-oriented opening stroke, a two-stage hydraulic stroke stop, which limits the opening stroke of the valve member and is embodied as a hydraulic damping chamber with a relief line, the relief line is made to communicate with the damping chamber via at least two recesses (17, 18) on the valve member, said recesses are opened in succession during an opening stroke motion of the valve member, and at least one of the recesses is made to communicate with a low-pressure chamber via a relief conduit (82) that contains a valve, and the damping chamber is provided in an intermediate disk (72) fastened between the valve body (10) and a valve retaining (42) body and is defined on an axial end opposite an end face of the valve body (10) by a piston (60), the piston is secured to the valve member and is guided slidingly displaceably and sealingly by an outer circumference along a wall of the damping chamber, said piston (60) includes:

a piston element (61) which has a bearing face and which rests on a curved contact face formed on the valve member;

a retaining element for fixing the piston element (61) to the valve member (20); and an elastic element disposed between the piston element and the retaining element.

2. The fuel injection valve of claim 1, in which the elastic element is an elastomer element, which fills the void disposed between the valve member (20), the piston element (61), and the retaining ring (72).

3. The fuel injection valve of claim 1, in which the retaining element (63) is inserted into a groove (230) disposed in the valve member (20) and secured by an annular element (110) surrounding the retaining element (63).

4. The fuel injection valve of claim 1, in which the contact face (29) is embodied spherically or toroidally, and that the bearing face of the piston element (61) is embodied in dome-like fashion complimentary to the contact face, or is embodied conically.

5. The fuel injection valve of claim 1, in which the retaining element (63) is pressed on said valve element and secured by a securing ring.

6. The fuel injection valve of claim 4, in which the elastic element is an elastomer element, which fills the void disposed between the valve member (20), the piston element (61), and the retaining ring (72).

7. The fuel injection valve of claim 4, in which the retaining element (63) is inserted into a groove (230) disposed in the valve member (20) and secured by an annular element (110) surrounding the retaining element (63).

8. The fuel injection valve of claim 4, in which the retaining element (63) is pressed on said valve element and secured by a securing ring.

9. The fuel injection valve of claim 1, in which the retaining element (63) is welded or is secured by positive engagement by means of a screw fastening.

10. The fuel injection valve of claim 1, in which the retaining element (63) is pressed by cold or hot pressing operations into grooves (200) that are embodied in the valve member (20).

11. The fuel injection valve of claim 1, in which the retaining element (63) is welded, by laser welding, onto the valve member (20).

12. The fuel injection valve of claim 4, in which the retaining element (63) is welded, by laser welding, onto the valve member (20).

13. The fuel injection valve of claim 4, in which the retaining element (63) is pressed by cold or hot pressing operations into grooves (200) that are embodied in the valve member (20).

14. A fuel injection valve for internal combustion engines, comprising a valve member (20) that is displaceable axially outward counter to a restoring force in a bore (13) of a valve body and that on an end toward the combustion chamber has a closing head (23), said closing head (23) protrudes from the bore (13) and forms a valve closing member and on a side of the valve closing head toward the valve body (10) has a valve sealing face, with which the valve sealing face cooperates with a valve seat face, said valve seat face is disposed on a face end toward the combustion chamber of the valve body, at least one injection opening on the closing head, the at least one injection opening originating at a pressure chamber with an outlet opening being covered, in the closing position of the valve member, by the valve body and being uncovered upon an outward-oriented opening stroke, a two-stage hydraulic stroke stop, which limits the opening stroke of the valve member and is embodied as a hydraulic damping chamber with a relief line, the relief line is made to communicate with the damping chamber via at least two recesses (17, 18) on the valve member, said recesses are opened in succession during an opening stroke motion of the valve member, and at least one of the recesses is made to communicate with a low-pressure chamber via a relief conduit (82) that contains a valve, and the damping chamber is provided in an intermediate disk (72) fastened between the valve body (10) and a valve retaining body (42) and is defined on an axial end opposite an end face of the valve body (10) by a piston (60), said piston is secured to the valve member and is guided slidingly displaceably and sealingly by an outer circumference along a wall of the damping chamber, the piston (60) includes:

a piston element which has a bearing face and which rests on a curved contact face (29) formed on the valve member; and a retaining element including a bearing face embodied on said retaining element, said bearing face rests on a further contact face (62) embodied on the piston element.

15. The fuel injection valve of claim 14, in which the retaining element (63) is welded, by laser welding, onto the valve member (20).

16. The fuel injection valve of claim 14, in which two contact faces (29, 62) are embodied spherically or toroidally with an identical point of symmetry, and that the bearing faces are embodied complimentary to the spherical faces or are embodied conically.

17. The fuel injection valve of claim 14, in which the retaining element (63) is pressed by cold or hot pressing operations into grooves (200) that are embodied in the valve member (20).

18. The fuel injection valve of claim 16, in which the retaining element (63) is pressed on said valve element and secured by a securing ring.

19. The fuel injection valve of claim 14, in which the retaining element (63) is inserted into a groove (230) disposed in the valve member (20) and secured by an annular element (110) surrounding the retaining element (63).

20. The fuel injection valve of claim 16, in which the retaining element (63) is inserted into a groove (230) disposed in the valve member (20) and secured by an annular element (110) surrounding the retaining element (63).

21. The fuel injection valve of claim 14, in which the retaining element (63) is pressed on said valve element and secured by a securing ring.

22. The fuel injection valve of claim 16, in which the retaining element (63) is pressed by cold or hot pressing operations into grooves (200) that are embodied in the valve member (20).

23. The fuel injection valve of claim 14, in which the elastic element is an elastomer element, which fills the void disposed between the valve member (20), the piston element (61), and the retaining ring (72).

24. The fuel injection valve of claim 16, in which the elastic element is an elastomer element, which fills the void disposed between the valve member (20), the piston element (61), and the retaining ring (72).

25. The fuel injection valve of claim 16, in which the retaining element (63) is welded, by laser welding, onto the valve member (20).

* * * * *